US006782815B2

(12) United States Patent
Massolt et al.

(10) Patent No.: US 6,782,815 B2
(45) Date of Patent: Aug. 31, 2004

(54) TEST PRINTING APPARATUS AND METHOD FOR TEST PRINTING, AND IRRADIATION ASSEMBLY FOR USE THEREWITH

(75) Inventors: Peter Robert Massolt, Heerenveen (NL); Frits Massolt, Drachten (NL)

(73) Assignee: Massolt Holding B.V., Heerenveen (NL)

( * ) Notice: Subject to any disclaimer, the term of this patent is extended or adjusted under 35 U.S.C. 154(b) by 0 days.

(21) Appl. No.: 10/411,958

(22) Filed: Apr. 11, 2003

(65) Prior Publication Data

US 2003/0213393 A1 Nov. 20, 2003

(30) Foreign Application Priority Data

Apr. 11, 2002 (NL) ..... 1020370

(51) Int. Cl.[7] ..... B41F 5/00; B41F 1/34; B41F 17/08; B41M 1/12

(52) U.S. Cl. ..... 101/216; 101/485; 101/129; 101/38.1

(58) Field of Search ..... 347/101, 102, 347/104, 19, 229, 234, 248; 427/466, 504; 101/484, 483, 485, 38.1; 73/866, 159; 250/492.1, 504 R

(56) References Cited

U.S. PATENT DOCUMENTS 4,592,276 A 6/1986 Dubuit ..... 101/38.1
4,644,899 A 2/1987 Glaus ..... 118/642
4,803,872 A * 2/1989 Crawford et al. ..... 73/150 R
4,873,470 A 10/1989 Myers ..... 315/240
4,898,037 A * 2/1990 Allen et al. ..... 73/866
5,133,209 A * 7/1992 Noguchi et al. ..... 73/78
5,415,054 A 5/1995 de Vos, Sr. et al. ..... 73/866
5,502,310 A 3/1996 Niestrath et al. ..... 250/492.1
5,985,376 A * 11/1999 Kamen ..... 427/504
6,124,600 A * 9/2000 Moroishi et al. ..... 250/504 R
6,126,731 A * 10/2000 Kemeny et al. ..... 106/31.6
6,221,302 B1 * 4/2001 Arai ..... 264/496
6,230,623 B1 * 5/2001 Dubuit ..... 101/485
6,562,413 B1 * 5/2003 Morgavi ..... 427/466
6,621,087 B1 * 9/2003 Bisges et al. ..... 250/492.1

FOREIGN PATENT DOCUMENTS

EP 0 312 475 4/1989

* cited by examiner

*Primary Examiner*—Charles H. Nolan, Jr.
*Assistant Examiner*—Wasseem H. Hamdan
(74) *Attorney, Agent, or Firm*—Pearne & Gordon LLP

(57) ABSTRACT

Test printing apparatus for test printing, wherein printing ink is printed on a test substrate. An ultraviolet irradiation assembly is mounted adjacent the rotary path of the bearing surface bearing the test substrate, for emitting ultraviolet radiation against the test substrate. The apparatus has a control arranged for controlling the drive for imparting to the bearing surface a speed in the sense of rotation, which during the irradiation of the test substrate by the irradiation assembly is different from the speed that is imparted by the drive to the bearing surface during the printing of the test substrate. An irradiation assembly and a method for test printing are also described.

6 Claims, 4 Drawing Sheets

TEST PRINTING APPARATUS AND METHOD FOR TEST PRINTING, AND IRRADIATION ASSEMBLY FOR USE THEREWITH

FIELD OF THE INVENTION

The invention relates to a test printing apparatus and a method for test printing, in which printing ink is printed on a test strip.

BACKGROUND OF THE INVENTION

U.S. Pat. No. 5,415,054 describes such a test printing apparatus. This apparatus can be used to simulate process parameters occurring on a rotary press, in order to determine suitable parameters for processing the combination of types of substrate and printing ink. Relevant parameters may be, for example: the pressure applied by the printing surface to the substrate, and the speed with which the printing surface rolls over the substrate. The drive of the bearing surface is therefore controllable for controlling the speed of movement of the bearing surface along the rotary path, and the pressure the printing surface applies to the test substrate on the bearing surface is also controllable in this appliance. The rotatable bearing surface in this apparatus is designed as a segment of the outer surface of a main disc and the printing surface is formed by a rubber outer surface of a printing disc which outer surface can be pressed against the outer surface of the main disc. Several of such printing discs can be provided which can be pressed against the main disc independently of each other.

When test printing is performed with printing ink that cures and/or dries under the influence of ultraviolet radiation, the substrate is removed from the bearing surface and transferred to an ultraviolet irradiator. This is laborious and variations in ambient conditions and the time that elapses between the printing and irradiation of the printed substrate can affect the result of the printing tests.

U.S. Pat. No. 4,592,276 describes an apparatus in which articles, such as bottles, are rotated in a printing station, are subsequently conveyed on a carrier to a curing station, and once again rotated in the curing station. This apparatus is complex and intended for printing circumferential surfaces of articles with an at least partly cylindrical form. However, this apparatus is rather complex due to the need to rotate the articles in two places and to convey them from the printing station to the curing station.

SUMMARY OF THE INVENTION

It is an object of the invention to provide a simple solution that enables a test substrate printed for testing purposes to be cured and/or dried by the impact of ultraviolet radiation without it being necessary to manually transfer the test substrate from a test print appliance to a curing appliance.

This object is achieved according to a first aspect of the invention by providing a test printing apparatus for test printing, in which printing ink is printed on a test substrate.

This apparatus is equipped with:

a bearing surface for bearing the test substrate, circulatable along a rotary path, a drive for circulating the bearing surface;

a detector for detecting at least defined rotary positions in a sense of rotation of the bearing surface;

at least one printing surface adjacent the path of the bearing surface for causing the printing surface to roll over a test substrate on the bearing surface for printing the test substrate;

a control communicating with the detector and with the drive for controlling the drive, depending on the position of the bearing surface, for causing the bearing surface to move in different sections of the rotary path with predetermined, different speeds in the sense of rotation; and an ultraviolet irradiation assembly mounted adjacent the path of the bearing surface for emitting ultraviolet radiation against the test substrate attached to the bearing surface.

Here, the control is arranged for actuating the drive for imparting to the bearing surface a speed in the sense of rotation which, during the irradiation, is different from the speed which the drive imparts to the bearing surface during the printing of the test substrate.

The invention can also be embodied in an irradiation assembly for coupling to a test printing apparatus for test printing, equipped with:

an ultraviolet radiation source and a light channel with an exit aperture for guiding ultraviolet radiation to an irradiatable part of a rotary path of a bearing surface for bearing a test substrate;

a control input for connection to a control unit of the test printing apparatus for receiving control signals from the control unit; and a light emission operating device for operating the emission of UV radiation in response to control signals received through the control input.

With this, a test printing apparatus can be extended to form a test printing apparatus according to the invention.

According to another aspect of the invention, this object is achieved by using a method for test printing, in which printing ink is printed on a test substrate, including:

circulating along a rotary path a test substrate borne by a bearing surface circulatable along the path;

detecting at least defined positions in the sense of rotation of the bearing surface;

rolling a printing surface over a test substrate on the bearing surface in a position along the rotary path which the test substrate passes along for printing the test substrate;

controlling the drive, depending on the position of the bearing surface, for causing the bearing surface to move in different sections of the rotary path with predetermined, different speeds in a sense of rotation; and after printing, emitting ultraviolet radiation against the test substrate in an irradiation section of the rotary path;

wherein the bearing surface, during the emission of ultraviolet radiation against the test substrate, is moved with a different speed in the sense of rotation than during the printing of the test substrate.

As the drive of the circulating surface is controlled for causing the bearing surface bearing the test substrate to move with different speeds in the sense of rotation during the printing and the curing of the ink by irradiation with ultraviolet radiation, the detector for determining at least defined positions of the bearing surface and the controllable drive are not only utilized for causing the printing surfaces to roll over the test strip during printing with controlled, optionally different speeds, but also for causing the test substrate to move with an adjusted speed during the curing. Thus, the speed of the test substrate is adjusted in a simple manner to the time needed to expose the test substrate to ultraviolet radiation for the desired length of time. In addition, the test substrate does not need to be taken off the bearing surface for curing and/or drying and the construction can be kept simple, because printing and irradiation take place along the same rotary path.

DETAILED DESCRIPTION

Figure 2:
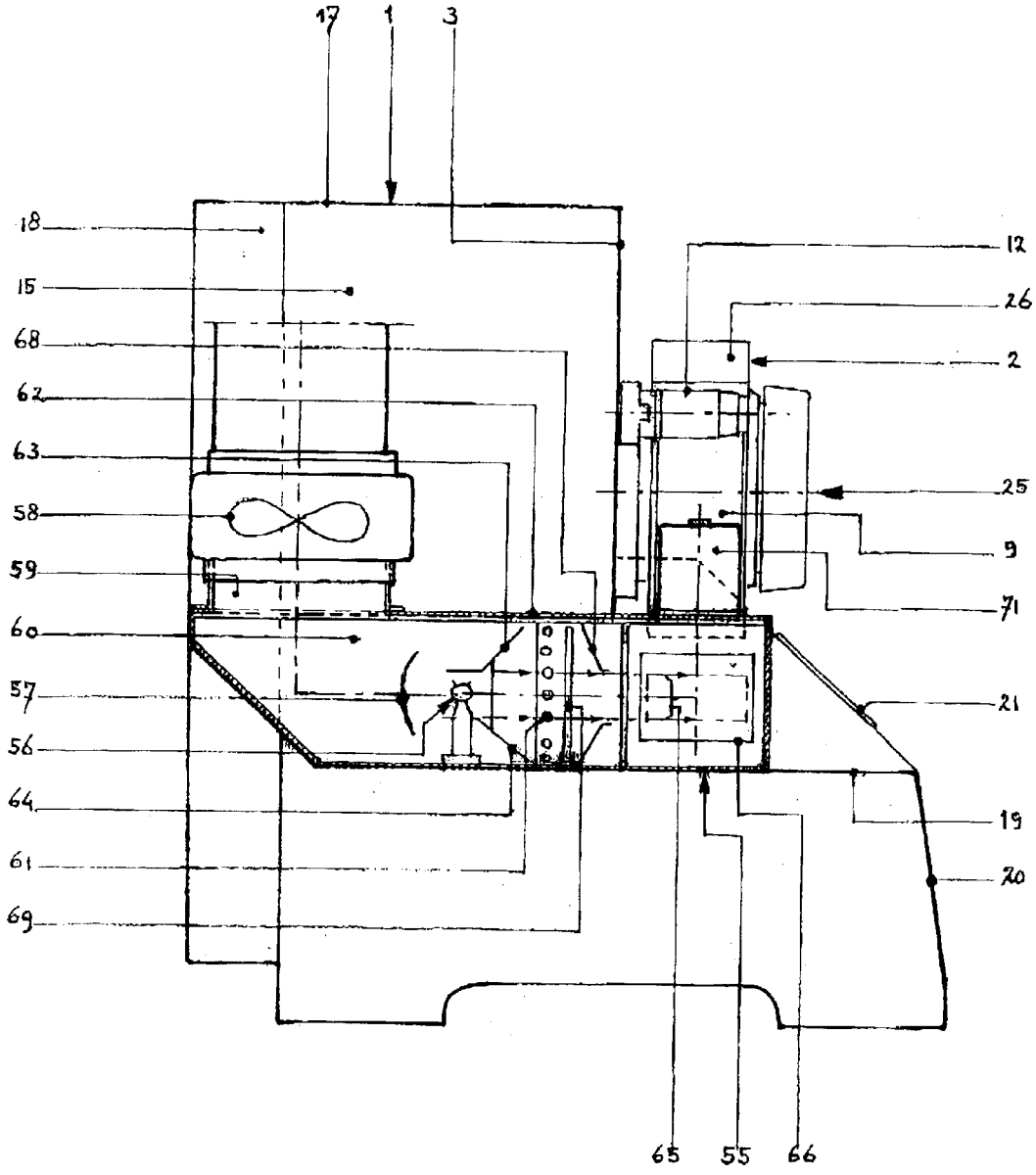
FIG. 2 is a side view of the apparatus according to FIG. 1.
Figure 3:
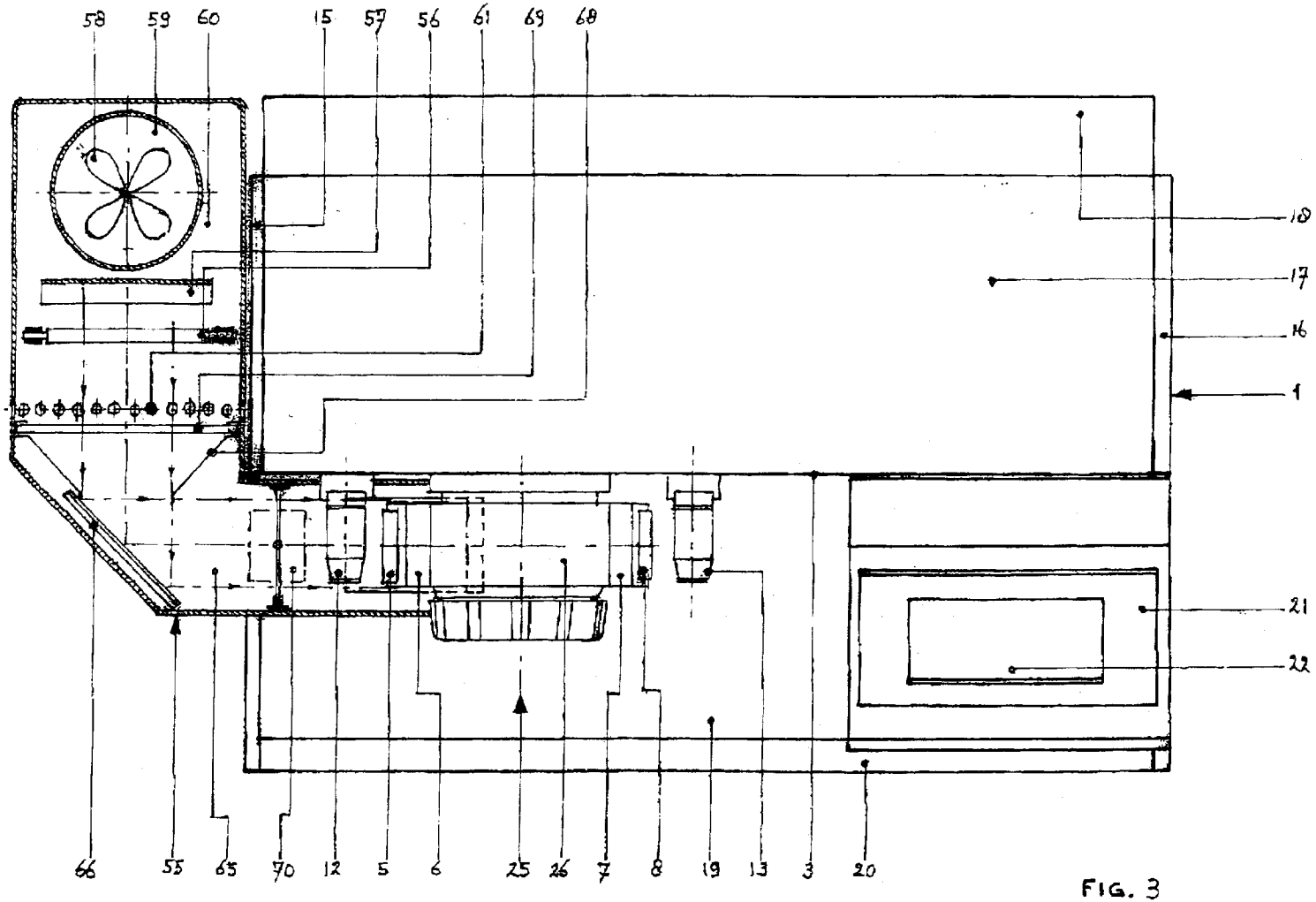
FIG. 3 is a side view of an apparatus according to FIGS. 1 and 2.

The apparatus according to the example represented in the drawing comprises a housing 1 from which a main disc 2 is suspended for rotation about its central axis. The main disc 2 is suspended in front of a front panel 3 of the housing 1. The main disc 2 has a circumferential surface 4 which is provided with slots 5–8 for receiving, in the sense of rotation, leading and trailing extremities of a test substrate 9. Two printing discs 10, 11 are each suspended adjacent the circumferential surface 4 for movement between a position in contact with the circumferential surface 4 of the main disc 2 and a position away from the circumferential surface 4. In FIGS. 2 and 3, bearings 12, 13 of the printing discs 10, 11 are represented without printing discs mounted thereon.

Further, an ultraviolet irradiation assembly 55 is mounted for emitting ultraviolet radiation against the test substrate 9 placed on the main disc 2. The irradiation assembly 55 comprises a radiation source 56 operatively generating ultraviolet radiation, in the form of a fluorescent lamp 56, which is placed in front of a reflector 57 for bundling radiation emitted by the lamp 56.

For cooling the irradiation assembly 55, there is provided a discharge channel 59 having therein a fan 58. The discharge channel communicates with the chamber 60 in which the lamp 56 has been fitted. For supplying air, passages 61 are provided in the housing 62 of the irradiation assembly 55, which passages are located upstream of the lamp 56 for admitting air which flows via the lamp 56 to the fan 58. In order to effectively cool the lamp 56, further, air guiding plates 63, 64 are provided in the chamber 60. The air guiding plates 63, 64 have a configuration converging towards the lamp 56 to a point near the lamp 56, so that the air flow in the area of the lamp 56 has a relatively high speed.

Through the irradiation assembly 55, from the lamp 56 and via a first and a second mirror 66, 67, a light channel 65 extends for guiding radiation, emitted by the lamp 56 to the main disc 2. The mirrors 66, 67 direct the beam of radiation such that it falls perpendicularly on the test substrate 9. The beam of radiation in the light channel 65 is bound by a window 68 placed behind a quartz filter 69 for filtering heat radiation. The air passages 61 for supplying air are placed near the quartz filter 69, so that cool air flowing in brushes along the quartz filter 69 and the quartz filter 69 too, is cooled.

Further, in the air channel 65, a shutter 70 is placed which can be controlled by an actuator 71, according to this example in the form of a linear electromagnet.

The air channel 65 terminates at the location of an exit passage 72 opposite the path of the circumferential surface 4 of the main disc 2.

The housing 1 further comprises a front panel 14, two sides 15, 16, a top side 17 and rear side 18. An apron 19 and a lower panel 20 project forwards from the front panel 3. On the apron 19 of the housing 1, a control panel 21 is present for operating a control computer 23. Further, a display 19 is provided, providing the operator with data concerning the status of the appliance and with which, by means of a menu structure, the operator can be guided, step by step, when programming the control computer 32 for carrying out different printing tests.

The circumferential surface 4 is approximately circular but deviates slightly from a pure circle form. The rotary bearing surface 24 of the circumferential surface 4 to which the test substrate 9, for instance in the form of a strip of paper, can be applied, has a radius $r_1$ and is bound at both extremities by the innermost of the slots 5–8 for receiving the extremities of a test substrate 9. The rotation axis 25 of the disc 2 forms the center of the radius $r_1$. The remainder 26 of the circumferential surface 4 is located inwards relative to the bearing surface 24, in that the radius $r_2$ has a center 27 which is in staggered relation relative to the center 25 of the radius $r_1$ such, that the effective radius of the remainder 26 of the circumferential surface 4 is smaller than that of the bearing surface 24. In operation, only the test substrate 9 on the bearing surface 24 contacts the printing discs 10, 11.

Between the positions of the discs 10, 11, viewed in circumferential direction of the main disc 2, there is an angle of θ°. This is the angle between the lines through the center line 25 of the main disc 2 and the center lines of the printing discs 10, 11. Preferably, this angle is selected such that a test strip 9 of a standard length of 20 cm can be printed over its entire length by one of the printing discs 10, 11 before it contacts the other one of the printing disc 10, 11.

The printing discs 10, 11 can be manufactured from various materials and may also be provided with, for instance, a rubber or polyurethane coating on the printing surface formed by the circumferential surface 73, 74 thereof which, during printing, is pressed against the test strip 9 and rolls over the test substrate 9.

In operation, rotation of the printing discs is driven by contact with the test strip 9 on the bearing surface 24 of the main disc 2. The printing discs 10, 11 can be brought into contact with the test strip 9 independently from each other.

As the radiation source 56 of the irradiation assembly 55 is located behind the front side 3 of the housing 1 and radiation emitted by the radiation source 56 is directed via the light channel 65 to the bearing surface 24, the hottest parts of the irradiation assembly 55 are not situated on the side of the housing 1 which, in use, faces the operator, but further away from the operator. Thus, the risk that the operator contacts the relatively warm housing parts is limited and exposure of the operator to heat radiation and warm air discharged from the irradiation assembly 55 is prevented or at least limited.

Figure 4:
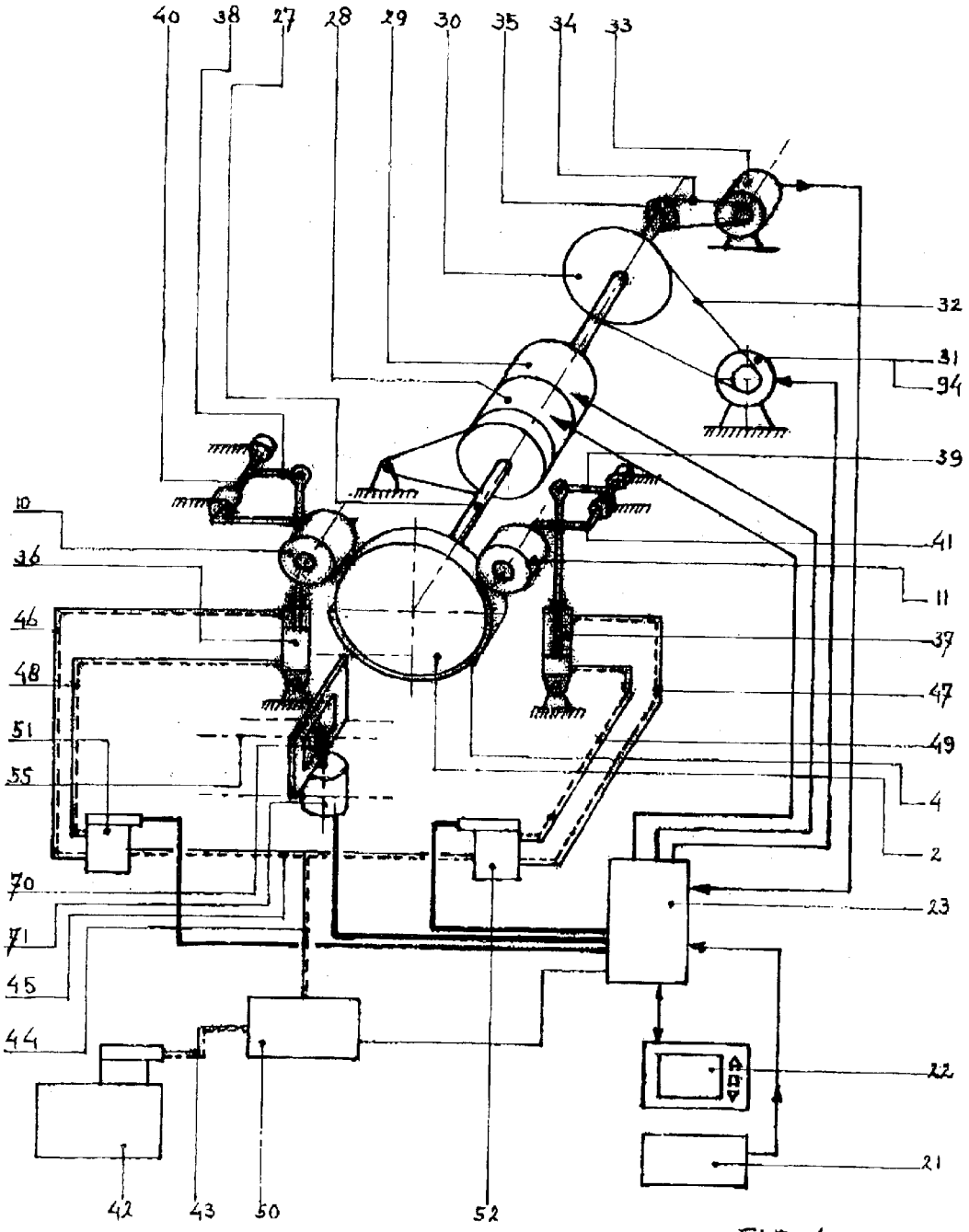
FIG. 4 is a schematic representation of the control and the drive of the bearing surface of the apparatus according to FIGS. 1–3.

FIG. 4 shows the driving system for rotating the main disc 2 and for contacting the printing discs 10, 11 with the test strip 9 and moving them back again. For reasons of clarity, the housing has been omitted in FIG. 4. The main disc 2 is mounted on the foremost extremity of a drive shaft 27. An electric brake 28, an electromagnetic coupling 29 and a flywheel 30 are also mounted on the shaft 27. The drive shaft 27 and the main disc 2 are freely rotatable relative to the brake 28, the coupling 29 and the flywheel 30 when the appliance is not in the testing condition. A direct current motor 31 with permanent magnet 94 and a drive belt 32 are used for driving rotation of the flywheel 30. When the coupling 29 is energized, a coupling is formed between the main disc and the fly wheel, so that, in operation, the main disc 2 starts to rotate along with the rotating flywheel 30.

When the main disc 2 is uncoupled from the flywheel 30 by the coupling 29, the brake 28 is activated for stopping the main disc 2. In order to control the brake 28, the coupling 29 and the motor 31, these are connected to the control computer 23. The actuator 71 for operating the shutter 70 is connected to the control computer 23 as well.

For providing information relating to the current position of the shaft 27 and the main disc 2, a rotatable coding unit 33 is coupled to the shaft 27 via a toothed belt 34 and a toothed pulley 35 on the shaft 27. The coding unit 33 is also coupled to the control computer 23, in this case, for continuously signaling the position of the shaft 27 and, when the coupling 29 is engaged (with, in engaged condition, a fixed mutual position of the coupling halves at the input and output side of the coupling) of the main disc 2. When the coding unit has been coupled to the shaft 27 on the driven side of the coupling 29, it is not necessary for the position of the input side relative to the output side to be fixed when the coupling 29 is engaged. In that case, when the apparatus is disengaged, the coding unit cannot deliver a signal that is representative of the speed of the part of the shaft 27 on the driving side of the coupling 29 cannot be measured.

For contacting the printing discs 10, 11 independently of each other with the test strip 9 and moving them back again, pneumatic working cylinders 36, 37 with connecting rods are provided which are coupled via arms 38, 39 to printing disc positioning shafts 40, 41 for rotating these shafts 40, 41. The bearings 12, 13 of the printing discs 10, 11 are mounted eccentrically on the foremost extremities of the printing disc positioning shafts 40, 41, so that the printing discs 10, 11 upon rotation of the printing disc positioning shafts 40, 41, move towards or, conversely, away from the main disc 2.

For generating pressure with which the working cylinders can be driven, the apparatus according to this example is provided with a compressor 42 which, via air channels 43–49, can thrust air under pressure to the pneumatic operating elements 36, 37. The compressed air is controlled by a pressure regulator 50 and selectively allowed to pass by control valves 51, 52.

The display 22 and the control panel 21 are used for entering test data into the control computer 23. Of those data, for instance the data representing the pressure to be applied are converted to a corresponding control signal for the pressure regulator 50 connected to the control computer. The control computer also controls the control valves 51, 52 connected thereto for allowing air to pass such that, at the intended times, the printing discs 10, 11 engage, or move away from, the test strip 9 on the main disc 2. The coding unit 33 continuously signals the position data regarding the main disc 2 to the control computer 23. The control computer 23 also controls the speed of the motor 31 and hence of the main disc 2 when the coupling 29 is in engagement.

In operation, a strip of material 9 on which a test print is to be applied is placed on the bearing surface 24 on the main disc 2 by means of clamps (not shown) in two of the slows 5–8 on either side of the bearing surface 24. During the placing of the test strip 9, the main disc is freely rotatable in order to facilitate placing of the test strip 9. To this end, both the brake 28 and the coupling 29 are released.

With the aid of menus indicating entry possibilities on the display 22, the operator programs the control computer for causing the desired test to be carried out. Entered variables can be the desired rotational speed of the main disc 2, the desired pressure and the number of revolutions during which printing takes place. A summary of the time during which printing takes place is represented on the display before the test is started.

The control computer 23 indicates on the display 22 whether the intended speed has been achieved. Thereupon, automatically or through operation of the control panel 21, the coupling 29 is brought into engagement, so that the main disc 2 starts to rotate along with the flywheel 30. While the main disc rotates, the coding unit 33 passes its position to the control computer 23. When the leading extremity of the test strip 9 on the bearing surface 24 reaches the first printing disc 11, the control computer 23 controls the coupling 29 to that it disengages and controls the brake 28 so that the main disc 2 is stopped with the test strip 9 in the starting position.

Then, the first control valve 52 is controlled by the control computer 23 for sending air under pressure to the first working cylinder 37 in order to contact the first printing disc 11 with the test strip 9 on the main disc 2. The pressure regulator 50 continuously regulates the pressure that is applied to the working cylinder 37 and hence that pressure with which the printing disc 11 is pressed against the test strip 9 on the bearing surface 24 on the main disc 2. After the first printing disc 11 has been pressed against the test strip 9, the coupling 29 is again driven for coupling the output part of the drive shaft 27 with the still rotating flywheel 30. The flywheel 30 has sufficient mass for causing the main disc to accelerate to the intended speed.

The printing disc 11 is carried along by the rotation of the main disc 2 and rolls over the test strip 9. After the desired portion of the test strip has been printed by the first printing disc 11, the control computer 23 controls the first control valve 52 for pressurizing the other compressed air channel 49 connected to the first working cylinder. As a result, the working cylinder 37 lifts the first printing disc 11 off the main disc 2 again.

If the control computer 23 is programmed for allowing a certain delay time to lapse, the coupling 29 is disengaged again and the brake 28 is operated again for stopping the main disc. After the intended delay has lapsed, the coupling 29 is brought into engagement again and in a corresponding manner the second disc 10 is brought into engagement with the test strip 9 and the printing part of the test is completed. Optionally, further printing discs may be provided with which in a same test further printings can be provided on the test strip 9.

For some tests, such as tests in which the surface to be printed is moisturized or remoisturized, the main disc 2 can make several revolutions, with the printing discs 10 and/or 11 being contacted with the test strip in each revolution. Also, delay intervals can be provided between successive revolutions. As the part 26 of the main disc 2 projects less far from the rotation axis 25 than the bearing surface 24, and the freedom of movement of the printing discs 10, 11 towards the rotation axis 25 of the main disc is limited, the printing discs 10, 11 are prevented from directly contacting the circumferential parts of the main disc 2.

For some tests, it is required that the speed at which the main disc 2 rotates increases gradually while a printing disc 10, 11 rolls over the substrate 9. To this end, via the control panel 21, a rotational speed can be selected that is variable over the length of the substrate, while initial velocity and final velocity can be entered.

The control computer 23 is further designed for controlling the drive for imparting to the bearing surface 24 in the irradiation path of the track a speed in the sense of rotation that is different from the speed imparted by the drive to the bearing surface 24 in a path in which the test substrate 9 on the bearing surface 24 is in contact with one or more of the printing discs 10, 11. Thus, the test substrate 9, after application of print by means of the printing discs 10 and 11 rolling over the test substrate 9, can be passed with a controlled speed along the exit opening 72 of the radiation assembly 55 for illuminating the test substrate 9 with UV radiation for a dosed exposure time. To that end, the test substrate 9 need not be taken from the disc 2 and for the control of the speed of movement of the test substrate 9, the same drive and control 23 are used as for controlling the movement of the test substrate 9 during the application of the printing.

The shutter 70 with the actuator 71 form a dimmer for regulating the ultraviolet radiation emitted to the test substrate 9 in the irradiation path. The dimmer communicates with the control computer 23 for regulating, depending on the position of the bearing surface 24, the radiation emitted to the irradiation path. Thus, the egress of ultraviolet radiation can be blocked or at least limited during the time when the test substrate is not to be exposed (for instance between printing runs) and during the time when no test substrate 9 is present in the area the beam of light can cover. Further, with the aid of the dimmer, also the intensity of the light beam during illumination can be regulated. To this end, the shutter can be placed in a position between a position in which it completely blocks the light beam and a position in which it allows the light beam to pass completely.

As the dimmer is equipped with a shutter 70, it can be operated very rapidly in a simple manner.

After a test has been completed, the test strip 9 is taken from the main disc 2 and the result is examined.

Figure 1:
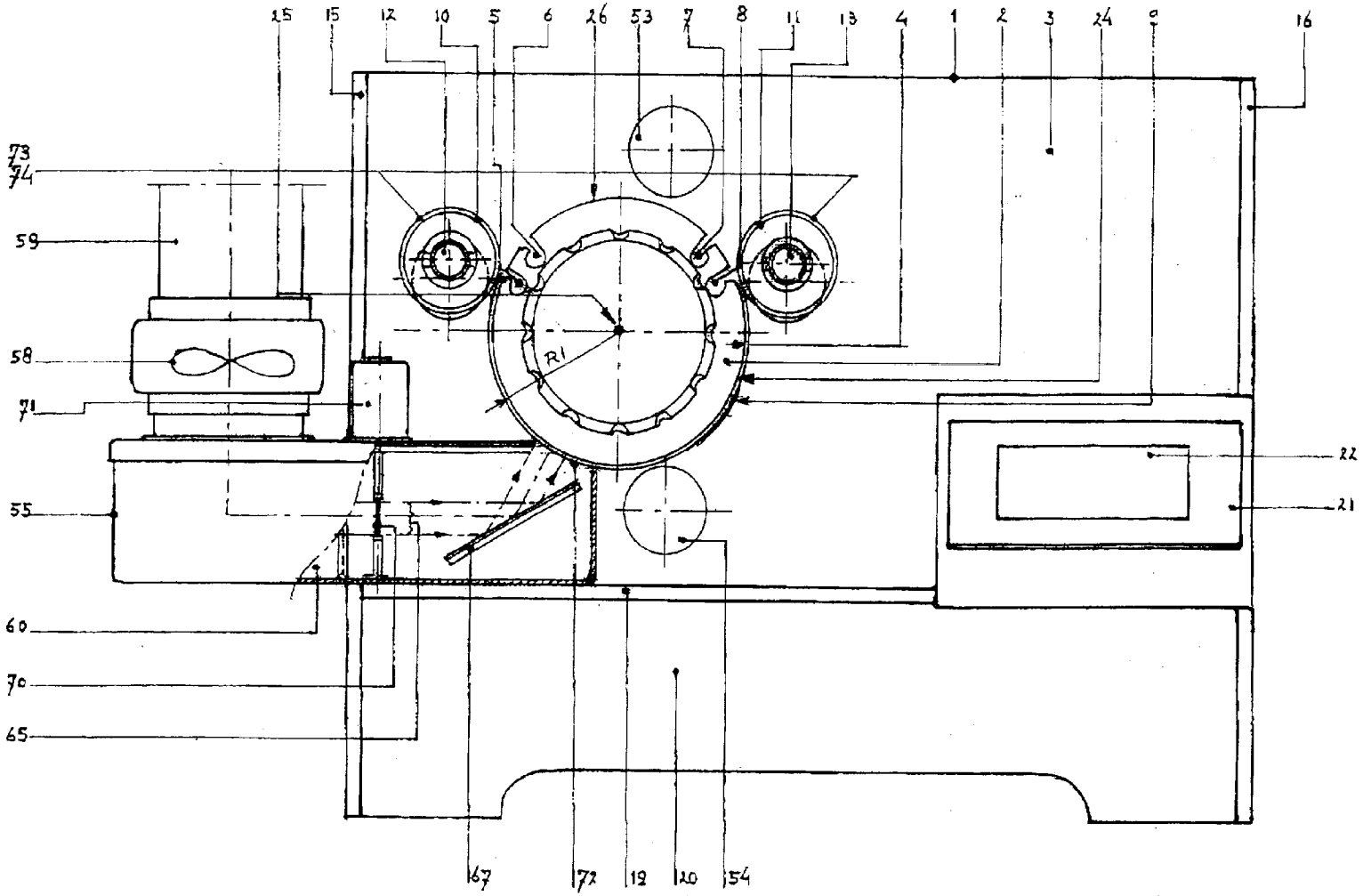
FIG. 1 is a side view of an example of an apparatus according to the invention.

It is noted that within the framework of the invention, there are many other possible embodiments other than the exemplary embodiment described hereinabove by way of example and represented in the drawing. For instance, according to the present example, the rotatable surface forms a segment of a cylindrical surface, but it is also possible to design the rotatable surface in a different manner, for instance as an outer surface of a revolving belt. Further, also more than two printing discs can be used, for instance by adding printing discs in the positions 53, 53 in FIG. 1.

Further, the radiation assembly 55 can also be supplied separately for use in combination with existing apparatus for doing printing tests, optionally in combination with software for the control computer 23 for driving, during the irradiation of the test substrate 9, the rotation of the main cylinder at a different speed than during the printing of the test substrate 9. The software can, for instance, be supplied in a form for programming the control computer, as memory provided with data to be coupled to the control computer, or as replacement for the control computer or a memory part thereof.

What is claimed is:

1. A test printing apparatus for test printing, in which printing ink is printed on a test substrate, which apparatus comprises:

a bearing surface for bearing the test substrate, circulatable along a rotary path, a drive for circulating the bearing surface;

a detector for detecting at least defined rotary positions in a sense of rotation of the bearing surface;

at least one printing surface adjacent the path of the bearing surface for causing the printing surface to roll over a test substrate on the bearing surface for printing the test substrate;

a control communicating with the detector and with the drive for controlling the drive, depending on the position of the bearing surface, for causing the bearing surface to move in different sections of the rotary path with predetermined, different speeds in the sense of rotation; and an ultraviolet irradiation assembly mounted adjacent the path of the bearing surface for emitting ultraviolet radiation against the test substrate attached to the bearing surface, wherein the control is arranged for controlling the drive for imparting to the bearing surface a speed in the sense of rotation which during irradiation of the test substrate by the irradiation assembly is different from the speed that the drive imparts to the bearing surface during the printing of the test substrate.

2. An apparatus according to claim 1, further comprising a dimmer for regulating the ultraviolet radiation emitted to the rotary path, which dimmer communicates with the control for controlling the ultraviolet radiation emitted to the rotary path, depending on the position of the bearing surface.

3. An apparatus according to claim 2, wherein the dimmer comprises a shutter.

4. An apparatus according to claim 2, wherein the control is arranged for operating the dimmer, depending on the position of the bearing surface, in such a way that the dimmer blocks at least part of the ultraviolet radiation when the bearing surface is outside a part of the rotary path that can be irradiated by the irradiation assembly and allows said at least part of the ultraviolet radiation to pass when at least a part of the bearing surface is within the part of the rotary path that can be irradiated by the irradiation assembly.

5. An apparatus according to claim 1, comprising a housing with a front side, wherein the bearing surface is suspended from the front side of the apparatus and wherein the irradiation assembly includes a radiation source for emitting ultraviolet radiation, situated behind the front side of the housing, further comprising a light channel for directing ultraviolet radiation emitted by the radiation source to the bearing surface.

6. A method for test printing, in which printing ink is printed on a test substrate, comprising:

circulating along a rotary path a test substrate borne by a bearing surface circulatable along the path;

detecting at least defined positions in a sense of rotation of the bearing surface;

rolling a printing surface over a test substrate on the bearing surface in a position along the rotary path along which the test substrate passes for printing the test substrate;

controlling the drive, depending on the position of the bearing surface, for causing the bearing surface to move in different sections of the rotary path with predetermined, different speeds in the sense of rotation; and after printing, emitting ultraviolet radiation against the test substrate in an irradiation section of the rotary path;

wherein the bearing surface, during the emission of ultraviolet radiation against the test substrate, is moved with a different speed in the sense of rotation than during the printing of the test substrate.

* * * * *